US006305477B1

(12) United States Patent
Carisella et al.

(10) Patent No.: US 6,305,477 B1
(45) Date of Patent: Oct. 23, 2001

(54) APPARATUS AND METHOD FOR MAINTAINING RELATIVELY UNIFORM FLUID PRESSURE WITHIN AN EXPANDABLE WELL TOOL SUBJECTED TO THERMAL VARIANTS

(75) Inventors: James V. Carisella, Harahan, LA (US); Paul J. Wilson, Houston, TX (US)

(73) Assignee: Weatherford International, Inc., Houston, TX (US)

( * ) Notice: Subject to any disclaimer, the term of this patent is extended or adjusted under 35 U.S.C. 154(b) by 0 days.

(21) Appl. No.: 09/292,452

(22) Filed: Apr. 15, 1999

(51) Int. Cl.[7] ..... E21B 33/122
(52) U.S. Cl. ..... 166/387; 166/134; 166/187
(58) Field of Search ..... 166/387, 187, 166/134

(56) References Cited

U.S. PATENT DOCUMENTS

| | | | | |
|---|---|---|---|---|
| 3,160,211 | | 12/1964 | Malone . | |
| 4,345,648 | | 8/1982 | Kuus | 166/106 |
| 4,349,204 | | 9/1982 | Malone | 277/34 |
| 4,601,457 | | 7/1986 | Austin et al. | 251/63 |
| 4,655,292 | | 4/1987 | Halbardier | 166/387 |
| 4,832,120 | | 5/1989 | Coronado | 166/187 |
| 4,869,324 | | 9/1989 | Holder | 166/387 |
| 5,046,557 | | 9/1991 | Manderscheid | 166/120 |
| 5,117,685 | * | 6/1992 | Goldschild | 166/319 |
| 5,259,456 | | 11/1993 | Edwards et al. | 166/319 |
| 5,320,182 | | 6/1994 | Mendez | 166/387 |
| 5,348,088 | * | 9/1994 | Laflin et al. | 166/134 |
| 5,417,289 | | 5/1995 | Carisella | 166/387 |
| 5,469,919 | | 11/1995 | Carisella | 166/387 |
| 5,495,892 | | 3/1996 | Carisella | 166/387 |
| 5,564,504 | | 10/1996 | Carisella | 166/387 |
| 5,605,195 | * | 2/1997 | Eslinger et al. | 166/187 |
| 5,718,292 | | 2/1998 | Heathman et al. | 166/387 |
| 5,813,459 | | 9/1998 | Carisella | 166/187 |

FOREIGN PATENT DOCUMENTS

| | | |
|---|---|---|
| 0290114 | 11/1988 | (EP) . |
| 2322394A | 8/1998 | (GB) . |
| 1113514A | 9/1984 | (SU) . |
| WO9836152 | 8/1998 | (WO) . |

OTHER PUBLICATIONS

Article entitled, "Proven Elastomer Compound for Extremely Hostile Geothermal and Oil Field Environments", by Hirasuna, et al., IADC/SPE 11407; 1983 Drilling Conference; Feb. 1983.

Article entitled, "Design and Testing of a High–Performance Inflatable Packer", by Eslinger, et al., SPE 37483; 1997 Production Operations Symposium; Mar. 1997.

* cited by examiner

*Primary Examiner*—William Neuder
(74) *Attorney, Agent, or Firm*—Fulbright & Jaworski L.L.P.

(57) ABSTRACT

A thermal compensating apparatus and method for maintaining a relatively constant fluid pressure within a subterranean well tool of the type that is responsive to a source of actuation fluid for manipulating said tool at a location in a well to at least one of sealing and anchoring positions. A body includes a fluid chamber within the body for housing a substantially incompressible fluid for manipulating said tool to at least one of the positions. The fluid chamber is expandable and contractible, for example, through movement of a piston, in response to manipulation of the tool and thereafter in response to thermal variations of the fluid in the fluid chamber. An energy storage and release mechanism, for example, a compression spring, is responsive to pressure changes in the fluid chamber for expanding or contracting the fluid chamber in response to pressure variations in the fluid for maintaining the fluid at a relatively constant pressure.

25 Claims, 3 Drawing Sheets

APPARATUS AND METHOD FOR MAINTAINING RELATIVELY UNIFORM FLUID PRESSURE WITHIN AN EXPANDABLE WELL TOOL SUBJECTED TO THERMAL VARIANTS

BACKGROUND OF THE INVENTION

1. Field of the Invention

The invention relates generally to subterranean well tools such as inflatable packers, bridge plugs or the like, which inflate through the introduction of fluid into an expandable elastomeric bladder and, more particularly, to a spring-loaded apparatus and method for maintaining a relatively uniform fluid pressure in the bladder when the tool is subjected to thermal variants after expansion.

2. Description of Problems

It is known among those skilled in the use of these types of inflatable devices that they are subject to changes in inflation pressure when the temperature of the inflation fluid varies from its initial inflation temperature. Typically, an increase in fluid temperature results in increased inflation pressures, and a decrease results in decreased inflation pressures. An increase in inflation pressure can make the tool susceptible to burst failure. A decrease in inflation pressure can diminish anchoring between the tool and the well bore to a point where the tool is not able to provide its intended anchoring function. In both instances, significant changes in temperature in the inflation fluid can result in compromised tool performance and possible tool failure. These failures can result in significant monetary loss and possible catastrophe.

The magnitude of temperature change needed to adversely effect the performance of an inflatable tool depends upon a number of parameters, such as, for example (1) the expansion ratio of the inflation element, (2) the relative stiffness of the steel structure of the inflation element compared with the compressibility and thermal expansion coefficient of the inflation fluid, (3) the relative stiffness of the casing and/or formation compared with the compressibility and thermal expansion coefficient of the inflation fluid, and (4) the anelastic properties of the elastomeric components in the inflation element. There are other factors of lesser significance known to those skilled in the relevant art.

Regardless of the specific values of the aforementioned parameters, conventional inflatable tools cannot tolerate positive or negative temperature changes greater than about 10–15° F.(5.6–8.3° C.) from the initial temperature at the end of their inflation cycle. If the temperature of the inflation fluid varies by more than this amount, the tool is subjected to excessive inflation pressures or insufficient inflation pressures, which could result in tool performance problems of the nature described above.

In addition, cycling the inflation fluid temperature within a ±15° F. of the initial temperature upon expansion can cause stress cycling in the steel structure of the inflation element and in the bladder. There is the potential for a serious problem when the inflation element survives routine thermal cycling for a finite period of time, during which cyclic damage in the tool accumulates. In such a case, failure can occur at some time after the rig has departed from the well site. Thus, an inflatable tool can provide short term functional performance during low magnitudes of thermal cycling. However, cumulative damage phenomena can occur in steel structures and/or elastomeric components and eventually cause device failure.

A time delayed failure can be more costly and possibly more catastrophic than one which occurs within a short time after the initial setting of the tool. Replacement of the failed device would entail performing a second project about equal in size and expense to the first service operation, instead of the case of a short-lived tool which would fail before the rig is broken down and moved off the site. Operations of this type can cost in excess of one hundred thousand dollars, and as high as several millions of dollars.

There are many operations in the oil and gas industry that successfully use pressure isolation devices which routinely encounter substantial thermal excursions and substantial magnitudes of combined positive and negative thermal cycling. Typically, inflatable devices are excluded as candidates for such projects. Typical projects are listed below.

large volume stimulation projects, n selective zone treatment projects, n large volume cement squeeze projects, n production packer service in oil and/or gas wells experiencing cooling from Joules-Thompson expansion and cooling of gases, n,c production packer service in oil and/or gas wells experiencing heating from deeper produced fluids, p,c conversion of a producing well to an injection well and temporary isolation between perforation intervals, n,c huff/puff steam injection methods for producing viscous oil formations, p,c

[n=these operations typically result in a large negative thermal excursion (cooling) in the pressure isolation device.]

[p=these operations typically result in a large positive thermal excursion (heating) in the pressure isolation device.]

[c=these projects typically repeated multiple thermal cycling in the pressure isolation device over long periods of time.]

The first five project categories are very common in the industry. Thousands of them are performed per year. The bottom two categories are relatively infrequent with respect to world wide activities.

If conventional packers and bridge plugs are not able to provide service for a given well configuration, because they are not able to pass through restrictions and subsequently set in casing, it is common to use a rig to pull tubing and perform a costly work-over project.

The use of thru-tubing inflatable devices provides well known benefits and versatility to the oil and gas industry. Their lack of service worthiness for operations that include thermal cycling and thermal excursions exclude them from a substantial portion of the remedial service sector. An invention that would eliminate the deleterious effects of routine thermal excursions and thermal cycling, would eliminate the aforementioned problems, augment the benefits and versatility of inflatable devices and provide substantial cost savings to operators in the industry.

DESCRIPTION OF THE PRIOR ART

Subterranean well tools, such as conventional packers, bridge plugs, tubing hangers, and the like, are well known to those skilled in the art and may be set or activated by a number of means, such as mechanical, hydraulic, pneumatic, or the like. Many of such devices contain sealing mechanisms which expand radially outwardly as the device is set in the well to provide a seal in the annular area of the well between the exterior of the device and the internal diameter of well casing, if the well is cased, other tubular conduit, or along the wall of open borehole, as the case may be.

Frequently, the seal is established subsequent to the setting of such device in the well and will be adversely effected by temperature variances of the device or in the vicinity of the device. Such temperature variances can cause expansion or contraction of the sealing mechanism, thus jeopardizing the sealing and even anchoring integrity of the device over time. For example, such devices are typically utilized in well stimulation jobs in which an acidic composition is injected into the formation or zone adjacent a well packer or bridge plug. As the stimulation fluid is injected into the zone, the temperature of the device and the well bore immediate the formation will be reduced.

If, for example, the well tool utilizes a sealing mechanism that includes an inflatable elastomeric bladder, the temperature of the fluid utilized to inflate the bladder and retain same in set position in the well is be affected by the temperature reduction during the stimulation job, causing a reduction of pressure within the interior of the bladder, fluid chambers and communicating passageways within the tool. This reduction in pressure, in turn, causes the bladder to contract from the initial setting position. In more dramatic situations, anchoring of the device in the well bore can be lost and the differential pressures across the device can cause "corkscrewing" of the coiled tubing or work string, resulting in project failure, expensive solution of the corkscrew problem and substantial operational risks.

On the other hand, the same inflatable tool is also be adversely affected by an increase in device temperature during certain types of secondary and tertiary injection techniques utilizing, for example, the injection of steam. As the steam is injected into the zone of the well immediate the set packer or well plug, the zone and accompanying devices, including tubing, quickly become exposed to the increased temperature. Some prior art devices containing inflatable packer components have been known to have the inflatable bladder element actually rupture, due to exposure to increased pressure within the bladder and interconnected chambers and passageways as steam flows through the device and is injected into the well zone.

In U.S. pat. No. 4,655,292, entitled "Steam Injection Packer Actuator and Method," a device is shown and disclosed, which addresses the problems associated with the prior art by providing a mechanism incorporating a compressible fluid, such as nitrogen. The fluid is used to accommodate an increase in temperature during steam injection and other operations for preventing the packer mechanism from rupturing as a result of exposure to enhance pressures resulting from the increase of temperature of inflation fluid and device components as stream flows through the device.

The present invention addresses the problems associated with prior art devices by maintaining a relatively constant inflation pressure even when the device experiences single and/or multiple thermal excursions of substantial magnitude. The invention operates to abate the adverse effects of any combination of heating and cooling, both quasi-static and dynamic cycling.

SUMMARY OF THE INVENTION

The present invention provides a spring-loaded apparatus and method for maintaining a relatively constant pressure in the tool with an inflatable bladder so that the integrity of the seal and anchor of a subterranean well tool is not compromised. The tool includes a body with a control mandrel carried by the body. A spring capable of storing energy such as, for example, a series of stacked bellville washers or other types of compression springs, are provided for receiving and storing energy transmitted to the spring by relative movement during each actuation of the tool, and subsequent thermal expansion of fluid within the expandable interior. The spring also releases any such stored energy upon thermal contraction of fluid within the expandable interior of the tool. In one embodiment, the spring has the property of exerting progressively higher force at correspondingly greater levels of deflection. Springs which exhibit that characteristic are known to those skilled in the art as progressive rate springs where rate is measured in units of force per lineal unit of deflection (e.g. pounds per inch). Such a progressive rate spring will deflect to some degree in response to bladder inflation pressure, but will not fully deflect in response to that pressure, thereby that spring will compensate for positive or negative temperature excursions.

The amount of energy required to actuate the tool when the bladder is inflated and the tool is expanded outwardly for anchoring and sealing the tool relative to the wall of the well is transmitted to the spring, such that the amount of energy stored in the spring is the difference between the hydrostatic pressure at the actuation depth and the actuation pressure of the actuating fluid. Accordingly, in the event of a reduction of temperature in the vicinity of the apparatus subsequent to setting, the energy stored within the spring is released into the expandable interior of the tool such that pressure within the tool is maintained at a relatively constant level.

Likewise, an increase in temperature surrounding the device subsequent to setting or manipulation of the tool is transferred into the spring such that the thermal increase does not cause any substantial expansion of fluid within the expandable interior of the tool and thus compromise its sealing or anchoring function. In this fashion, all thermal variances within the actuation fluid subsequent to the setting or actuation of the tool are absorbed through the energy storage capability of the spring for possible subsequent usage in adjusting pressure of fluid within the interior of the tool.

DESCRIPTION OF THE DRAWINGS

A better understanding of the invention can be obtained when the detailed description of preferred embodiments described below is considered in conjunction with the appended drawings, in which.

DESCRIPTION OF PREFERRED EMBODIMENTS

Figure 1:
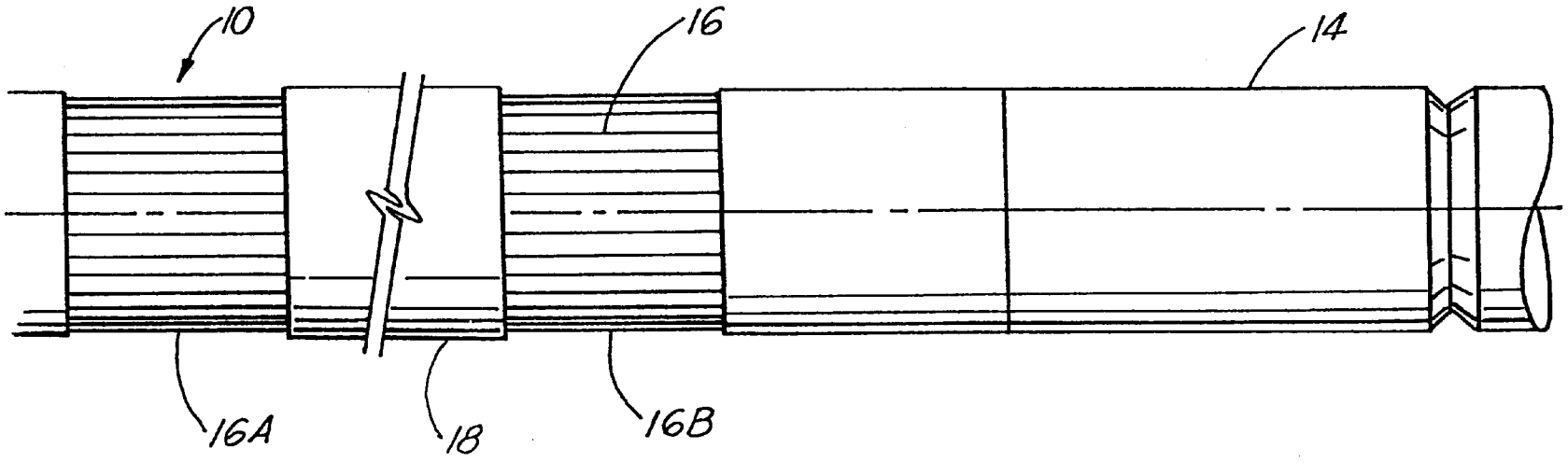
FIG. 1 is a plan view of an unexpanded tool, such as an inflatable packer, in which the present invention can be utilized.

Referring first to FIG. 1, a down hole tool such as an inflatable packer 10 is shown, in which the invention can be used. The invention can also be used in many other types of down hole tools which utilize inflatable elements of the type described. The packer 10 includes upper and lower collars 12, 14, respectively. The packer 10 is connected in conventional fashion, such as by threads, connector, or otherwise, through the upper collar 12 to a carrier T extending to the top of the well. The carrier T may be a tubular conduit, such as coiled tubing, a section of work string, electric line, or the like.

The packer 10 includes a series of metallic ribs or slats 16 which overlap and extend longitudinally between the collars 12, 14, in conventional fashion. A conventional bladder (not shown) formed of an elastomeric material is provided beneath the ribs 16, which can be expanded through the introduction of pressurized fluid from any number of sources in a well known way.

The tool 10 includes exposed rib sections 16A and 16B that are separated by an elastomeric cover or seal section 18. Although an arrangement is shown in FIG. 1 where two exposed rib sections are separated by a cover section, the invention can be applied to expandable tools of any number of sizes and configurations, and is not limited to the tool illustrated in FIG. 1.

When pressurized fluid is introduced into the bladder causing it to expand (not shown), the ribs 16 and cover section 18 expand outwardly into contact with the casing or other conduit in which the tool 10 is located. Typically, the exposed anchor sections 16A, 16B, operate as an anchor for the tool, while the cover section 18 operates as a seal.

The thermal compensating apparatus of the present invention is shown in FIGS. 2–5, and is generally identified by reference number 20. The apparatus 20 is connected to the tool 10 shown in FIG. 1 through a sleeve 22 that is connected to the lower collar 14 of the tool 10. In other words, the apparatus 20 is located below the tool 10 when it is run down hole.

Figures 2, 3:
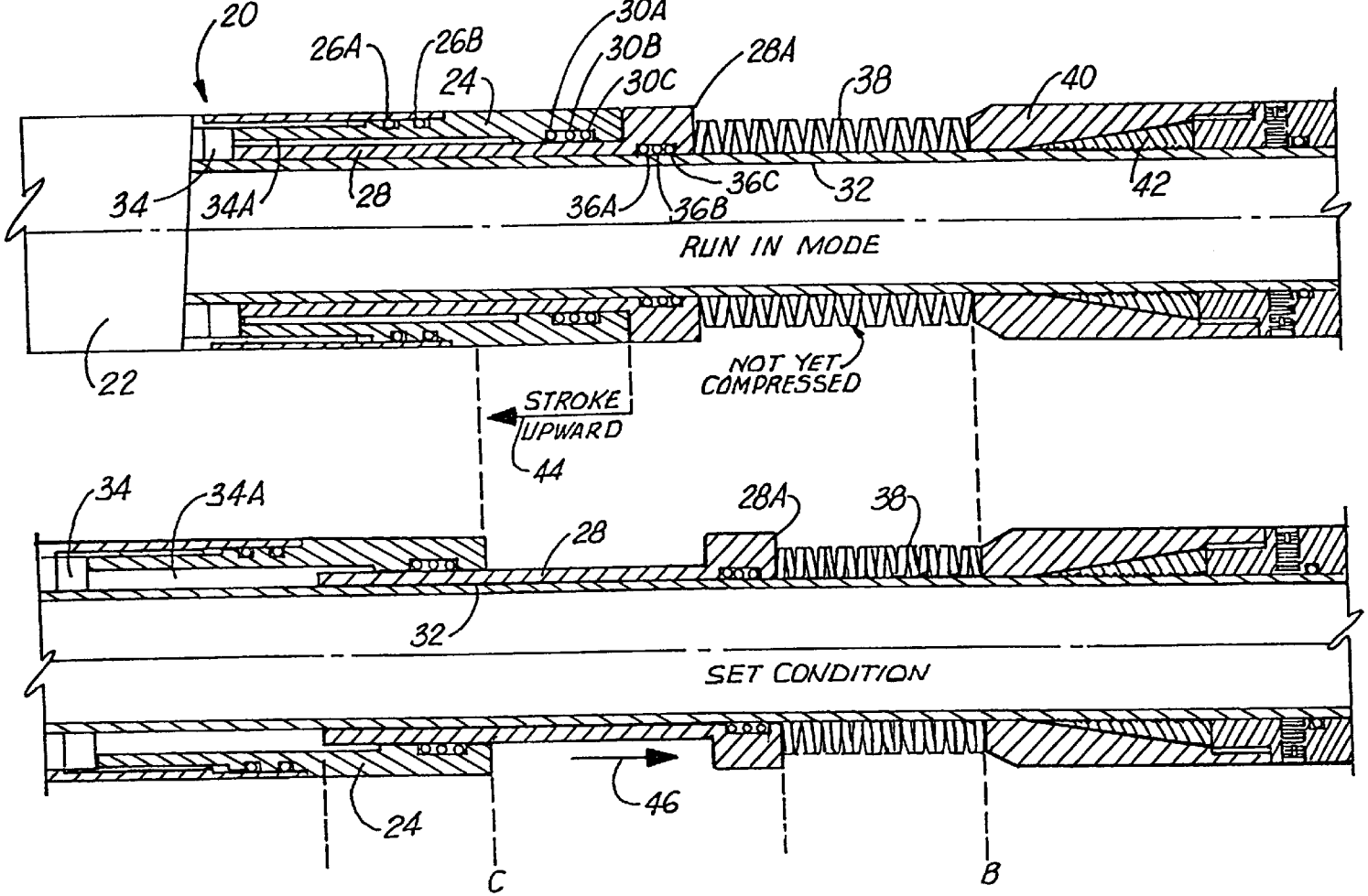
FIG. 2 is a partial cross-sectional view of the thermal compensating apparatus of the present invention connected at the lower end of the packer of FIG. 1, showing the apparatus in its run-in position.
FIG. 3 is a partial cross-sectional view of the apparatus of FIG. 2 in its set position.

Referring to FIG. 2, the apparatus is shown in its run-in mode before the actuating fluid has been introduced to expand the bladder and actuate the tool 10. The sleeve 22 is secured by threads or other suitable connector (not shown) in a way well known in the art, to a slide sub 24. A pair of elastomeric O-ring seals 26A, 26B, are disposed in a groove formed in the slide sub 24, between the sleeve 22 and the slide sub 24, for preventing the passage of fluid. A piston 28 is positioned for movement inside and relative to the slide sub 24. Piston 28 is also positioned for movement outside and relative to mandrel 32. Three elastomeric O-ring seals 30A, 30B and 30C, are positioned in a groove formed in the slide sub 24 for providing a fluid-tight seal between the slide sub 24 and the piston 28.

It will be appreciated that the piston 28 is not secured to the slide sub 24, but is positioned inside the slide sub 24 and outside mandrel 32. A fluid chamber 34 is formed in the upper end of the apparatus 20, which communicates with the interior of the tool 10 for receipt of fluid used for expanding the bladder and actuating the tool 10. A passageway 34A is located between the outer surface of the piston 28 and the inner surface of the slide sub 24, which communicates with the fluid chamber 34.

Three O-ring seals 36A, 36B, and 36C, are positioned in a groove formed in the inner surface of the piston 28, for providing a fluid tight seal between the inner surface of the piston 28 and the outer surface of the mandrel 32.

The piston 28 has a lower face 28A, which is in contact with the upper most end of a spring 38, which as shown in FIGS. 2–5 is a series of stacked Belleville washer elements. Although the Belleville washers are the preferable form of spring for this invention, other types of compression springs that are capable of storing energy could also be used. The Belleville washers are shown in their expanded position, which is the position when little or no energy is stored in them.

A jam nut 40 is shouldered against the lower most end of the spring 38 for resisting movement of the spring 38. The jam nut 40 can include a tapered inner surface for engaging a slip 42 that fixedly secures jam nut 40 in place.

FIG. 3 shows the positions of the various components of the thermal compensating apparatus 20 when actuating fluid under pressure has been introduced into the tool 10 to expand the bladder and set the tool 10. The actuating fluid is a substantially incompressible fluid, for example, water, other aqueous fluids, a cementitious fluid, or the like.

When fluid under pressure is introduced into the tool 10, it also flows into the fluid chamber 34 and the passageway 34A. The pressurized fluid causes the inflation tool to expand which in turn causes the lower collar 14 to move upwardly along with the sleeve 22 and the slide sub 24 to position C in FIG. 3, as illustrated by arrow 44. The pressurized fluid acts on the piston 28 and moves it downward toward the spring 38, as illustrated by the arrow 46, until it reaches the position B shown in FIG. 3.

The increase of pressure within the fluid chamber 34 and the passageway 34A is thus transmitted to the spring 38, causing the spring 38 to compress as shown in FIG. 3 and store an amount of energy related to the product of the difference between the hydrostatic well pressure at the actuation depth of the tool 10 and the pressure within the fluid chamber 34 times the projected area of the end of piston 28 and the amount of deflection of the stack of springs.

Figures 4, 5:
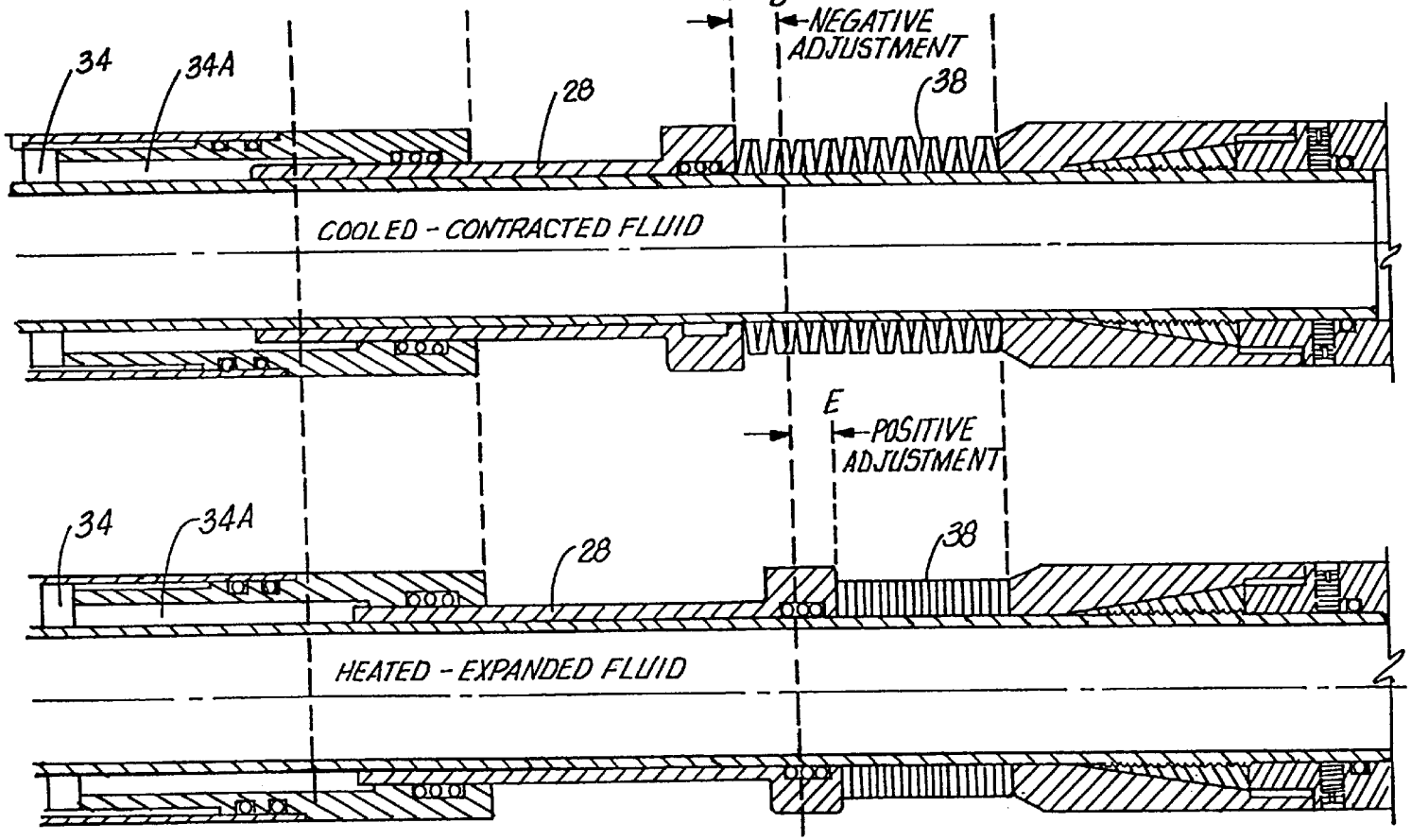
FIG. 4 is a partial cross-sectional view of the apparatus of FIG. 2 in its thermally contracted condition.
FIG. 5 is a partial cross-sectional view of the apparatus of FIG. 2 in its thermally expanded condition.

FIG. 4 illustrates the relative positions of the components of the thermal compensating apparatus 20 in the event that fluid within the chamber 34 and passageway 34A contracts because of cooling in the vicinity of the tool 10 during, for example, transmission of fluid through the tubing T and into the adjacent formation (not shown). In such event, the energy stored within the spring 38 is released through the piston 28 which moves upwardly relative to the slide sub 24 and the sleeve 22 from position B to position D. This movement causes the fluid chamber 34 to contract and effectively stabilize pressure within the tool 10 so that fluid pressure is maintained at a substantially constant level which is about the same as the pressure required to maintain the sealing function of the tool 10.

FIG. 5 shows the relative positions of the components of the thermal compensating apparatus 20 when the fluid in chamber 34 and the passageway 34A expands because the tool 10 is exposed to a heating effect, for example, when steam used in tertiary recovery operations is introduced through the tubing T or in situ heating occurs when a well is shut in. This heating effect causes increased fluid pressure within the fluid chamber 34 and passageway 34A. As shown in FIG. 5, this increase in fluid pressure causes the piston 28 to move downwardly relative to the sleeve 22 and the slide sub 24, to position E, and cause the spring 38 to compress. This increase in fluid pressure is converted into stored energy in the spring 38, and operates to maintain the fluid pressure in the tool 10 at substantially the same level as when the tool was initially actuated.

It will be appreciated that a spring having any number of configurations can be used in the thermal compensating apparatus 20. Preferably, a series of ten pairs of opposing sets of stacked Belleville washers, having a length of about 6"–9", are used for a tool such as gravel pack tool which is about 2⅛" in diameter, which be run through a 2.31" diameter restriction in 2⅞" production tubing. These dimensions have been found suitable for compensating for temperature fluctuations of ±15–20° F. For tools exposed to greater fluctuations, for example ±75–100° F., a longer spring mechanism would be used. Alternatively, one or more coiled metallic springs or discs may be utilized. When force/energy storage mechanisms like Belleville washer springs of apparatus 20 the combined tools composed of apparatus 10 and apparatus 20 is able to maintain relatively constant inflation pressure within tool 10 and therein maintain functional performance under circumstances where conventional tools like inflatable tool 10 would fail. Those skilled in the art will be able to calculate the de-compressive or expansive force required of a suitable spring and other required parameters.

Although the invention has been described in terms of specified embodiments which are set forth in detail, it should be understood that this is by illustration only and the invention is not necessarily limited thereto, since alternative embodiments and operating techniques will become apparent to those skilled in the art in view of the disclosure. Accordingly, modifications and improvements are contemplated which can be made without departing from the spirit of the described invention.

We claim:

1. A thermal compensating apparatus for maintaining a relatively constant fluid pressure within a subterranean well tool, said apparatus comprising:

(a) a body with a longitudinal axis, said body being adapted for connection to the well tool;

(b) a mandrel in the body, said mandrel being movable along the longitudinal axis relative to the body;

(c) at least one compression spring, one portion of said at least one compression spring being fixed relative to the mandrel; and (d) a fluid chamber located between said body and said mandrel and in communication with actuation fluid used for activating said tool, said compression spring being positioned relative to said fluid chamber such that said spring compresses or extends as said fluid chamber expands or contracts, respectively, in response to thermal variations in the fluid.

2. The thermal compensating apparatus of claim 1 wherein said at least one compression spring has a progressive spring rate.

3. An thermal compensating apparatus for maintaining a relatively constant fluid pressure within a subterranean well tool of the type that includes a bladder that is selectively expandable upon the introduction of pressurized actuation fluid, for activating said tool at a location in a well, said apparatus comprising:

(a) a body with a longitudinal axis, said body being adapted for connection to the well tool;

(b) a mandrel in the body, said mandrel being movable along the longitudinal axis relative to the body; and (c) a compression spring, one portion of which is fixed relative to the mandrel;

(d) a fluid chamber located between the body and mandrel, said fluid chamber being in communication with actuation fluid used for activating the tool; and (e) a piston located between the fluid chamber and compression spring movable in response to pressure changes in the actuation fluid, the piston being adjusted so that increases in fluid pressure will tend to move the piston and store energy in the spring, and decreases in fluid pressure will tend to cause the spring to release energy and move the piston, for effecting changes in the size of the fluid chamber and maintaining a relatively constant pressure in the actuating fluid when the fluid is subjected to pressure variants.

4. The thermal compensating apparatus of claim 3 wherein said at least one compression spring has a progressive spring rate.

5. The thermal compensating apparatus of claim 3, wherein the body comprises an outer sleeve, and said piston is concentrically disposed relative to said sleeve and telescopically movable relative to said sleeve to transmit energy to or from said compression spring upon actuation of said well tool, and thereafter upon thermal expansion or contraction of actuation fluid.

6. The thermal compensating apparatus of claim 3, wherein said compression spring comprises a series of stacked Belleville washer components.

7. The thermal compensating apparatus of claim 3, wherein the energy stored in the compression spring is equal to the pressure within the fluid chamber upon actuation of said tool.

8. The thermal compensating apparatus of claim 3, wherein the energy stored in the compression spring subsequent to activation of said tool may be increased in relation to thermal expansion of activation fluid within said fluid chamber at an amount substantially equal to the actuation pressure of said actuation fluid.

9. The thermal compensating apparatus of claim 3, wherein the energy stored in the compression spring subsequent to actuation of said tool may be decreased in relation to the thermal contraction of actuation fluid in said fluid chamber, and said stored energy may be applied within said fluid chamber for retaining pressure in said fluid chamber substantially equal to the actuation pressure of the actuation fluid.

10. The thermal compensating apparatus of claim 3, wherein said piston is telescopically mounted on said mandrel.

11. The thermal compensating apparatus of claim 5, wherein said piston is positioned between the exterior of said mandrel and the interior of said sleeve.

12. The thermal compensating apparatus of claim 11, wherein a differential pressure area is defined across said sleeve and said piston and said differential area is exposed to hydrostatic well pressure at the setting depth of said tool.

13. The apparatus of claim 1, wherein said compression element includes a compression spring, said apparatus further comprising a piston positioned between said fluid chamber and said compression spring, said piston being movably responsive to fluid in the fluid chamber so as to transfer energy from the fluid to said compression spring and to allow expansion of said fluid chamber.

14. A thermal compensating apparatus for maintaining a relatively constant fluid pressure within a subterranean well tool of the type that is responsive to a source of actuation fluid for manipulating said tool at a location in a well to at least one of sealing and anchoring positions, said apparatus comprising:

(a) a body;

(b) a fluid chamber within said body for housing a substantially incompressible fluid for manipulating said tool to at least one of said positions;

(c) the fluid chamber being expandable and contractible in response to manipulation of said tool and thereafter in response to thermal variations of said fluid in said fluid chamber; and (d) an energy storage and release mechanism responsive to pressure changes in the fluid chamber and adapted to allow for expansion or contraction of the fluid chamber in response to thermal variations in the fluid so as to maintain the fluid at a relatively constant pressure, the mechanism including a compressible element positioned relative to said fluid chamber such that said compressible element compresses to store energy transferred thereto from the fluid or expands to release energy transferred thereto from the fluid.

15. The thermal compensating apparatus of claim 14, wherein said compressible element of the energy storage and release mechanism comprises a compression spring.

16. The thermal compensating apparatus of claim 14, wherein the energy storage and release mechanism comprises a series of stacked Belleville washers.

17. The thermal compensating apparatus of claim 14, wherein the amount of energy stored in said energy storage and release mechanism upon manipulation of said tool to at least one of said positions is substantially equivalent to the pressure of said actuation fluid within said fluid chamber.

18. The thermal compensating apparatus of claim 14, and further including a piston that is movable to store or release energy in said energy storage and release mechanism in response to changes in the pressure of said fluid caused by temperature variances.

19. The thermal compensating apparatus of claim 14, wherein storage and release of energy by said energy storage and release mechanism in response to pressure changes in the fluid retains fluid pressure in said fluid chamber approximately equal to the pressure of said actuation fluid required to manipulate said tool to at least one of said positions.

20. A method for maintaining a relatively constant fluid pressure within a subterranean well tool of the type that is responsive to a source of actuation fluid for manipulating said tool at a location in a well to at least one of sealing and anchoring positions, comprising the steps of:

(a) expanding and contracting a fluid chamber containing said actuation fluid in response to manipulation of said tool and thereafter in response to thermal variations of said fluid in said fluid chamber;

(b) providing an energy storage and release mechanism that includes a compression element positioned relative to said fluid chamber so as to be movably responsive to variations in the fluid in said fluid chamber;

(b) storing or releasing energy in said energy storage and release mechanism in response to expansion or contraction of said fluid chamber so as to maintain the fluid at a relatively constant pressure, whereby said compression element is compressed to store energy transferred thereto from said fluid chamber as said fluid chamber expands or expands to release energy as said fluid chamber contracts.

21. The method of claim 20, wherein the energy storage and release mechanism comprises a compression spring.

22. The method of claim 20, wherein the energy storage and release mechanism comprises a series of stacked Belleville washers.

23. The method of claim 20, and further including the step of maintaining the amount of energy stored in said energy storage and release mechanism upon manipulation of said tool to at least one of said positions substantially equivalent to the pressure of said actuation fluid within said fluid chamber.

24. The method of claim 20, and further including the step of moving a piston to store or release energy in said energy storage and release mechanism in response to changes in the pressure of said fluid caused by temperature variances.

25. The method of claim 20, and further including the step of maintaining the storage and release energy by said energy storage and release mechanism in response to pressure changes in the fluid approximately equal to the pressure of said actuation fluid required to manipulate said tool to at least one of said positions.

* * * * *